US005687497A

United States Patent [19]

Moore

[11] Patent Number: 5,687,497

[45] Date of Patent: Nov. 18, 1997

[54] FLUID VESSEL AMUSEMENT

[76] Inventor: Steven Jerome Moore, 9 Sonoma Rd., Cortlandt Manor, N.Y. 10566

[21] Appl. No.: 581,894

[22] Filed: Jan. 2, 1996

[51] Int. Cl.[6] ..... G09F 19/02

[52] U.S. Cl. ..... 40/406; 40/324; 446/14; 446/71; 446/176; 446/267

[58] Field of Search ..... 40/324, 406, 412, 40/439, 440; 446/14, 71, 176, 210, 267

[56] References Cited

U.S. PATENT DOCUMENTS

| | | | |
|---|---|---|---|
| 1,933,763 | 11/1933 | Russell | 40/324 |
| 2,182,570 | 12/1939 | Rosenblatt | 40/406 |
| 2,453,177 | 11/1948 | Abramson | 40/406 |
| 2,590,279 | 3/1952 | Soss | 446/14 X |
| 2,741,693 | 4/1956 | Fasson | 40/406 |
| 2,763,142 | 9/1956 | Hepner | 40/406 X |
| 3,564,740 | 2/1971 | Calfee | 40/406 |
| 3,782,195 | 1/1974 | Meek et al. | 40/324 X |
| 4,239,223 | 12/1980 | Wilson | 40/324 X |
| 4,928,412 | 5/1990 | Nishiyama | 40/324 |
| 5,029,700 | 7/1991 | Chen | 446/71 X |
| 5,339,548 | 8/1994 | Russell | 40/324 |
| 5,389,030 | 2/1995 | Chapkis | 40/412 X |
| 5,553,735 | 9/1996 | Kimura | 40/324 X |

*Primary Examiner*—Brian K. Green
*Assistant Examiner*—Andrea Chop

[57] ABSTRACT

A heat-activated amusement display disposed within the walls of a cup or other vessel.

7 Claims, 5 Drawing Sheets

FLUID VESSEL AMUSEMENT

BACKGROUND OF THE INVENTION

1. Field of the Invention

This invention relates generally to an amusement device, and particularly to a fluid vessel with a heat-activated display disposed therein.

2. Description of the Prior Art

Vessels for retaining liquid have been known since the dawn of mankind. For millennia, these vessels have been decorated by means of paint or carvings in order to enhance the enjoyment of the person drinking from them.

Conventionally, the application of vessel decorations has been limited to the outer and inner surface of the vessel. The development of vessels manufactured from transparent double cylinders wherein the base caps the bottom end, however, has permitted decorations to be placed between the cylinders and therefore within the wall of the vessel.

Intra-vessel wall decorations have until only very recently been entirely static in nature. That is, these vessels have housed stationary "display window"-like scenes to enhance the enjoyment of the person drinking from the vessel.

U.S. Pat. No. 4,928,412 to Nishiyama describes a dynamic fluid-filled display housed within the walls of a vessel. The fluid-filled display is described as containing decorative particles suspended in the fluid. A decorative sheet-like liner is placed between the sidewall and inner wall of the cup. A dynamic display is formed by agitating the fluid in the walls of the vessel by means of a bellows pump housed in the handle of the vessel.

Vessels are often used to house hot liquids. The heat eminating from hot liquids has for centuries been used as an energy source. Heretofore, however, the heat eminating from a hot liquid housed within a vessel has not been used to enhance the decorative nature of a vessel.

SUMMARY OF THE INVENTION

In general, the present invention provides for a dynamic display disposed within the housing of a vessel. In particular, the present invention provides for coupling the heat energy produced by a hot liquid contained within the vessel to a heat-activated dynamic display.

In accordance with the present invention, a vessel containing a dynamic display activated by heat is disclosed. The vessel is comprised of a vessel body having an outer vessel shell, an inner vessel shell, and a display shell interposed between. The display shell, which may be self-enclosed or formed by a discontinuous contact between the outer and inner vessel shell, houses in an energy-activating cell a display liquid which is preferably of lower boiling point than the liquid intended to be contained within the vessel. For example, the display liquid may be ethyl alcohol containing a dye, and the liquid contained in the vessel water.

When exposed to a source capable of heating liquid, such as a microwave, the liquid in the energy-activating cell boils prior to the liquid within the vessel itself. The lower boiling point liquid both expands in volume and produces vapor. The expansion of the liquid or vapor production can be coupled to an apparatus housed in a motion cell to produce motion. For example, a fly wheel could be rotated by a jet directed at it. As a further example, the expanded liquid could be shunted through a series of ducts, such as is seen in a house radiator system, the ducts in such example comprising the motion cell and apparatus. Preferably, substantially all of the liquid shunted from the energy activating cell is re-collected in the energy-activated cell by means of collecting ducts connecting from the motion apparatus to the cell.

In one embodiment of the invention, the energy activating cell is positioned in the inner vessel shell such that it is in close proximal positional contact with the liquid within the vessel. Such close proximal positional contact permits exchange of heat from the hot liquid within the vessel to the energy activating cell. In another embodiment of the invention, the motion apparatus and collecting ducts are housed in the outer shell of the vessel such as to be as far from the hot inner surface of the vessel as possible. Such distal positional contact permits the release of heat into the air surronding the vessel permitting more efficient condensation and condensation of the liquid which has passed through the motion cell. A heat shielding layer may be interposed between the proximal and distal positions such that the distal position is more effectively shielded from the heat generated by the hot liquid within the vessel.

It is preferred for the liquid within the energy activating cell to be of a generally lower boiling point than the liquid to be poured into the vessel. It is further preferred for the volume of liquid and atmosphere with the energy activating cell to be such that upon heating of the liquid and atmosphere there is enough expanded liquid or vapor produced to activate the motion apparatus, but not enough to cause a breach of the display shell due to pressure buildup in the display shell. Preferrably, a pressure release valve attached to a pressure release conduit is supplied. One type of pressure release valve permits excess pressure to be released when the vessel is in an upright position, but does not permit liquid to flow through the pressure release conduit when the vessel is turned upside down. Such valves are well-known in the art.

The object of this invention is also attained in disclosing a vessel with dynamic display interposed therein comprising: an outer vessel shell; an inner vessel shell to be filled with heated fluid; a display shell interposed between the outer vessel shell and said inner vessel shell; a motion device within the display shell which is activated by the heat of the fluid in the inner vessel.

The object of this invention is also attained in disclosing a vessel with a heat-activated liquid-based dynamic display comprising: an outer vessel shell; an inner vessel shell to be filled with heated fluid; a display shell interposed between the outer vessel shell and said inner vessel shell; a fluid-containing cell within the display shell; a motion device cell capable of movement by fluid housed within the motion device cell; a connecting means for connecting the liquid-containing cell to the motion device cell.

In another embodiment of the invention a heat-sensitive detector is placed within the inner shell of the vessel in proximity to the liquid. Such detector is electronically coupled to activate an electronic motion device housed within the motion shell of the vessel.

BRIEF DESCRIPTION OF THE DRAWINGS

For a more complete understanding of the objects of the present invention, the Detailed Description of the Illustrative Embodiments thereof is to be taken in connection with the following drawings, in which.

DETAILED DESCRIPTION OF THE ILLUSTRATIVE EMBODIMENT OF THE PRESENT INVENTION

Figure 1:
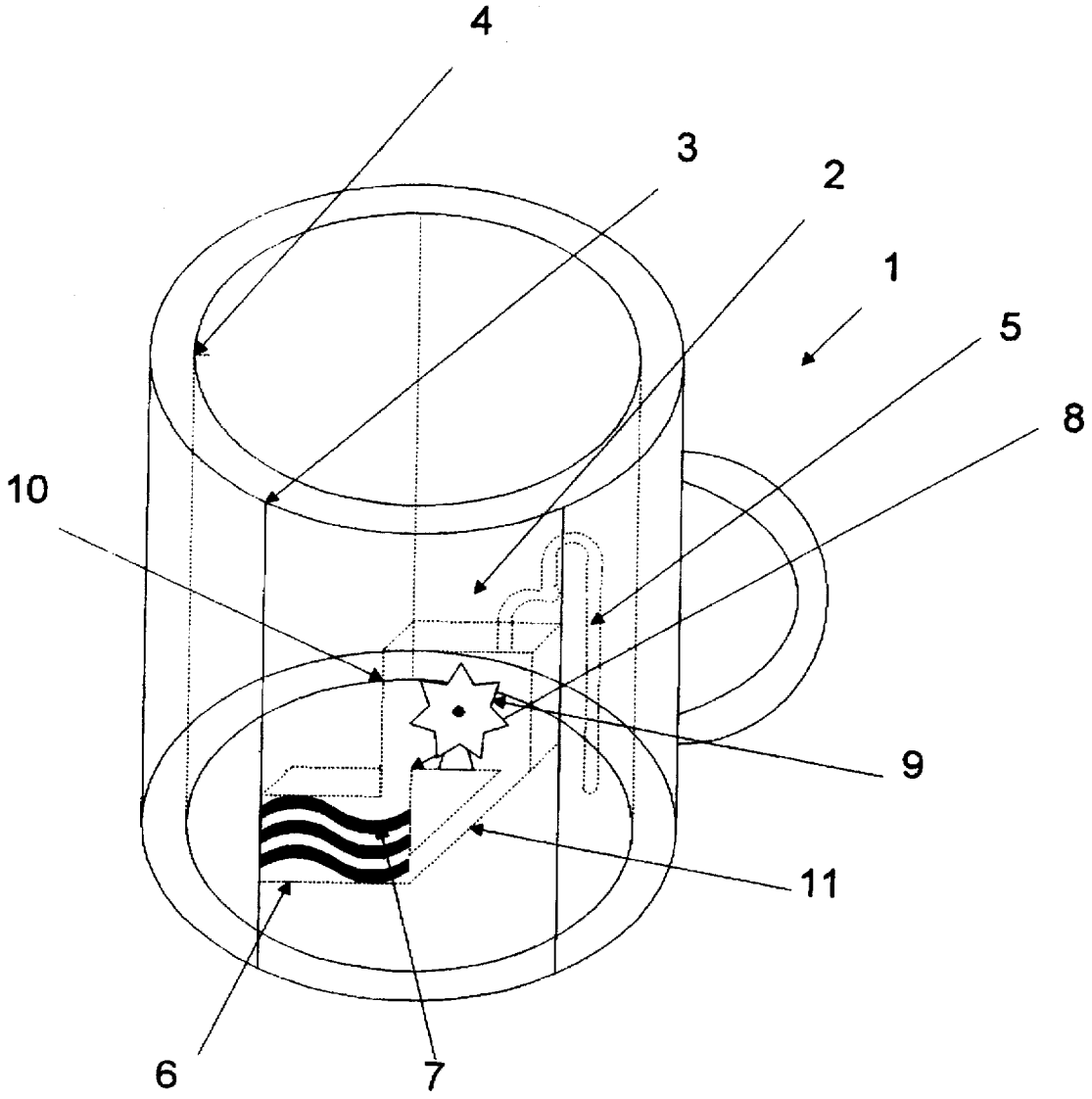
FIG. 1 is a cross-sectional view of a cup with a heat-activated liquid dynamic display disposed therein.

Referring to FIG. 1 of the drawings, there is shown exemplary vessel 1 with heat-activated dynamic display 2. The vessel comprises outer vessel shell 3 and inner vessel shell 4 which may be in continuous contact, in discontinuous contact, or in non-contact with each other. Interposed between the outer vessel shell 3 and inner vessel shell 4 is dynamic display 2 which may be a separate shell, interconnected to either or both of inner vessel shell 4 and outer vessel shell 3, or simply cavities formed by the interconnection of outer vessel shell 3 and inner vessel shell 4. Disposed within the display shell is energy activating cell 6 which contains a relatively low boiling point liquid 7. Connected to the display shell is inlet duct 8 which leads to motion apparatus 9, in this case a fly wheel, contained in motion cell 10. Exiting from the motion apparatus cell is an outlet duct 11. Attached to the display shell is a pressure-release conduit 5.

Figure 2:
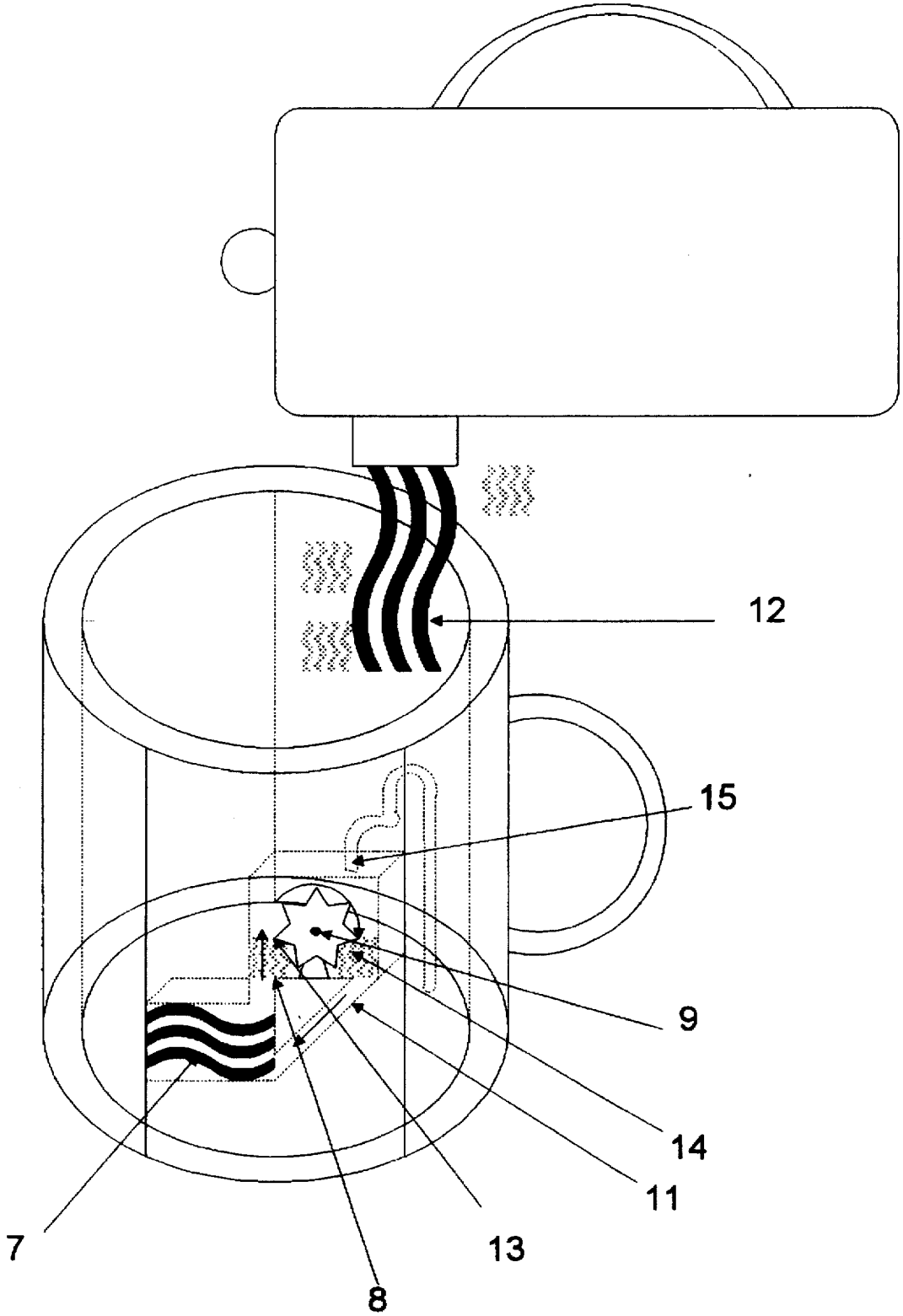
FIG. 2 is a schematic of the mechanism by which motion is produced in a cup with a heat-activated liquid dynamic display disposed therein.

As seen in FIG. 2, hot liquid 12 is poured into the vessel. It should be understood that cold liquid could also be placed into the vessel and such liquid heated in a heat generating source, for example, a microwave. Hot liquid 12 heats liquid 7 in energy activating cell 6 causing liquid 7 to heat and expand in volume. Vapor 13 from the liquid is directed through inlet duct 8 to motion apparatus 9 causing the wheel to turn. After turning the wheel, vapor 13 condenses 14 back into liquid 7 and is returned via outlet duct 11 back to energy activating cell 6. If excess pressure should build up in the display shell, pressure is relieved through a pressure valve (not shown) attached to pressure-release conduit 5.

Figure 3:
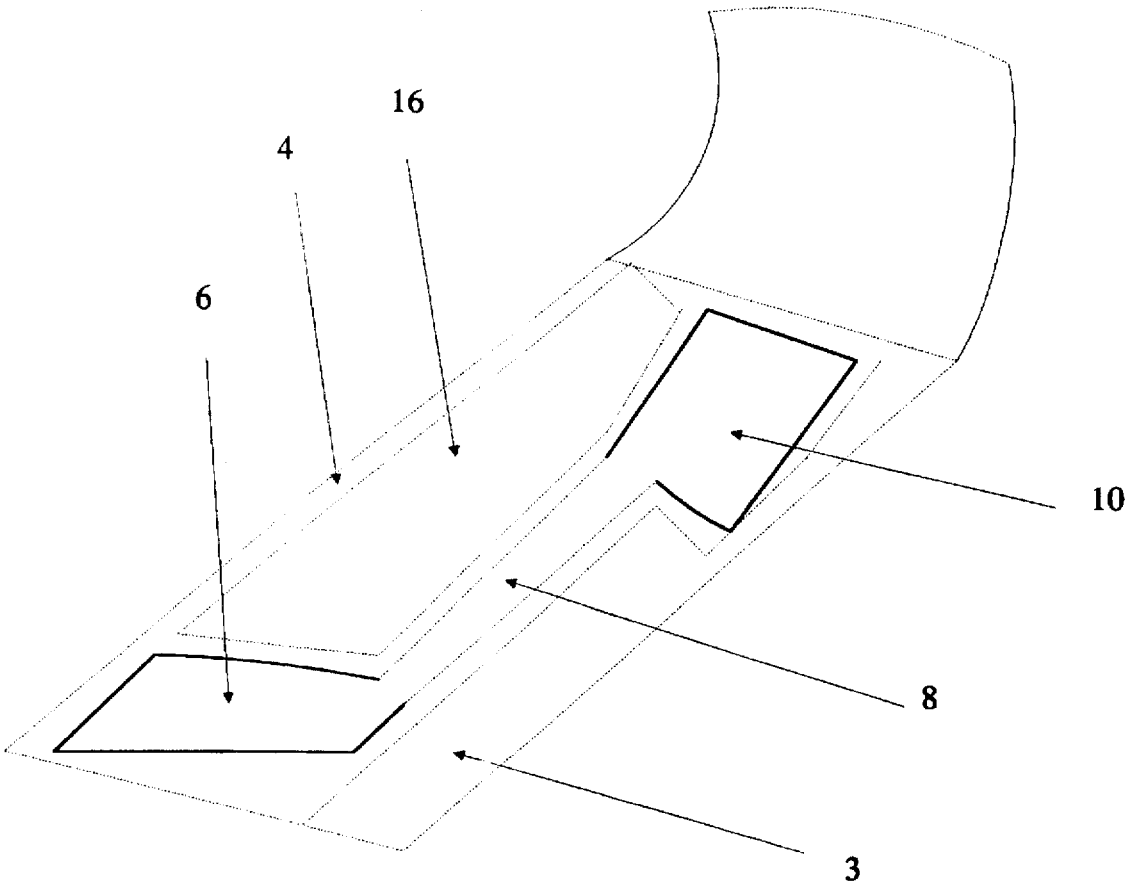
FIG. 3 is a horizontal cross-sectional view of a cup with a heat-activated liquid dynamic display disposed therein, cut at the level of the display shell.

Referring now to FIG. 3, FIG. 3 shows a horizontal cross-sectional view of a cup with a heat-activated liquid dynamic display disposed therein, cut at the level of the display shell. Energy activating cell 6 is connected by inlet duct 8 to motion cell 10. Energy activating cell 6 is postioned such that it is proximal to the hot liquid placed in the vessel. Motion cell 10 is positioned distal from the hot liquid placed in the vessel and is shield from the hot liquid by heat shield 16 comprising part of inner shell 4. Outer shell 3 is composed of a material which permits efficient transfer of heat from motion cell 10 and outlet duct 11 (see FIG. 2).

Figure 4:
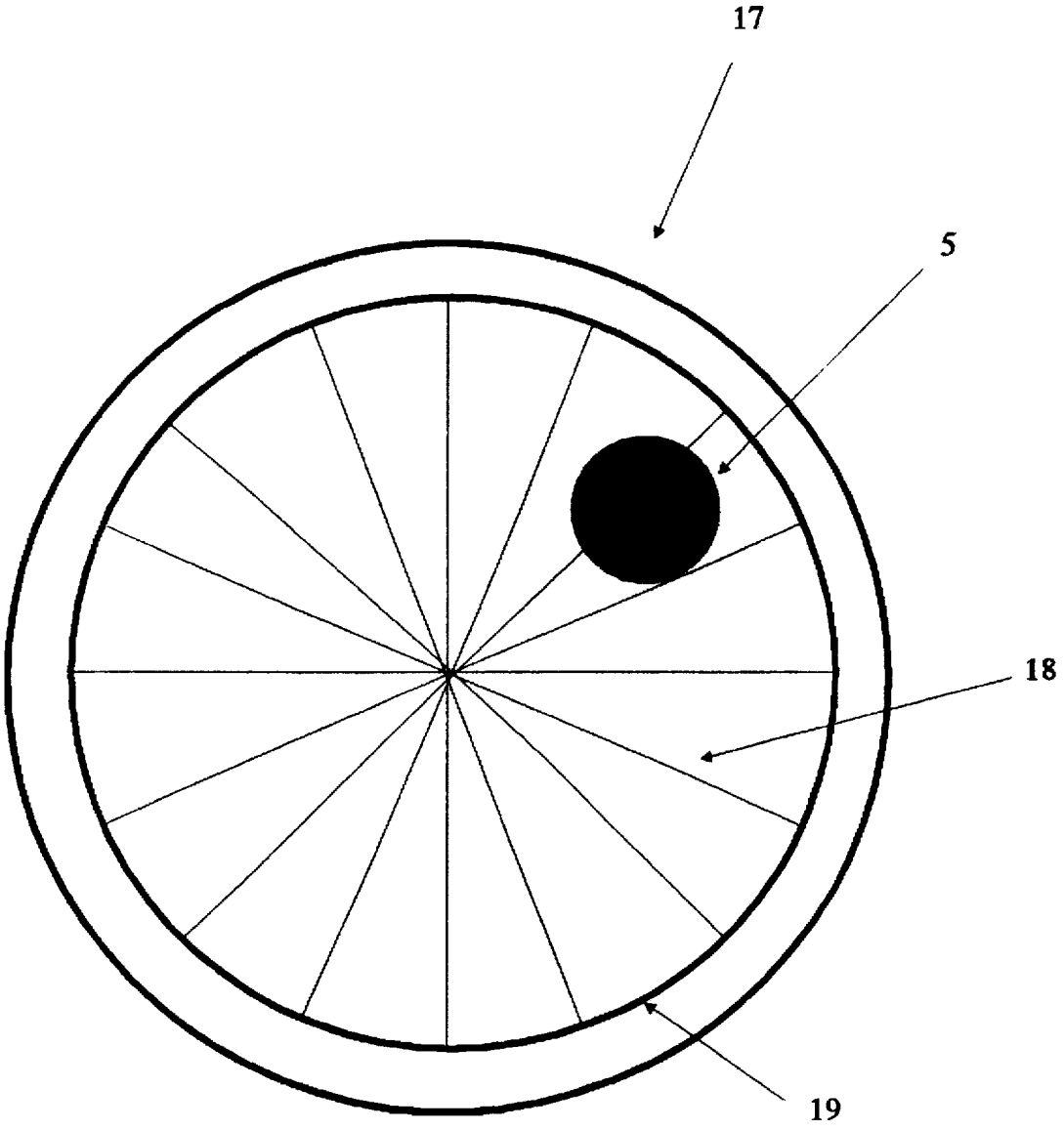
FIG. 4 is a inferior view of the bottom of a vessel with a heat-activated liquid dynamic display disposed therein and further comprising a pressure-release conduit exiting at the bottom of the vessel.

Referring now to FIG. 4, FIG. 4 shows an inferior view of the bottom of vessel 17 with pressure-release conduit 5 exiting through the bottom. Mesh 18 is positioned over inner lip 19 of the bottom of vessel 17, such that it covers the opening of pressure release conduit 5 to inhibit tampering with the opening.

Figure 5:
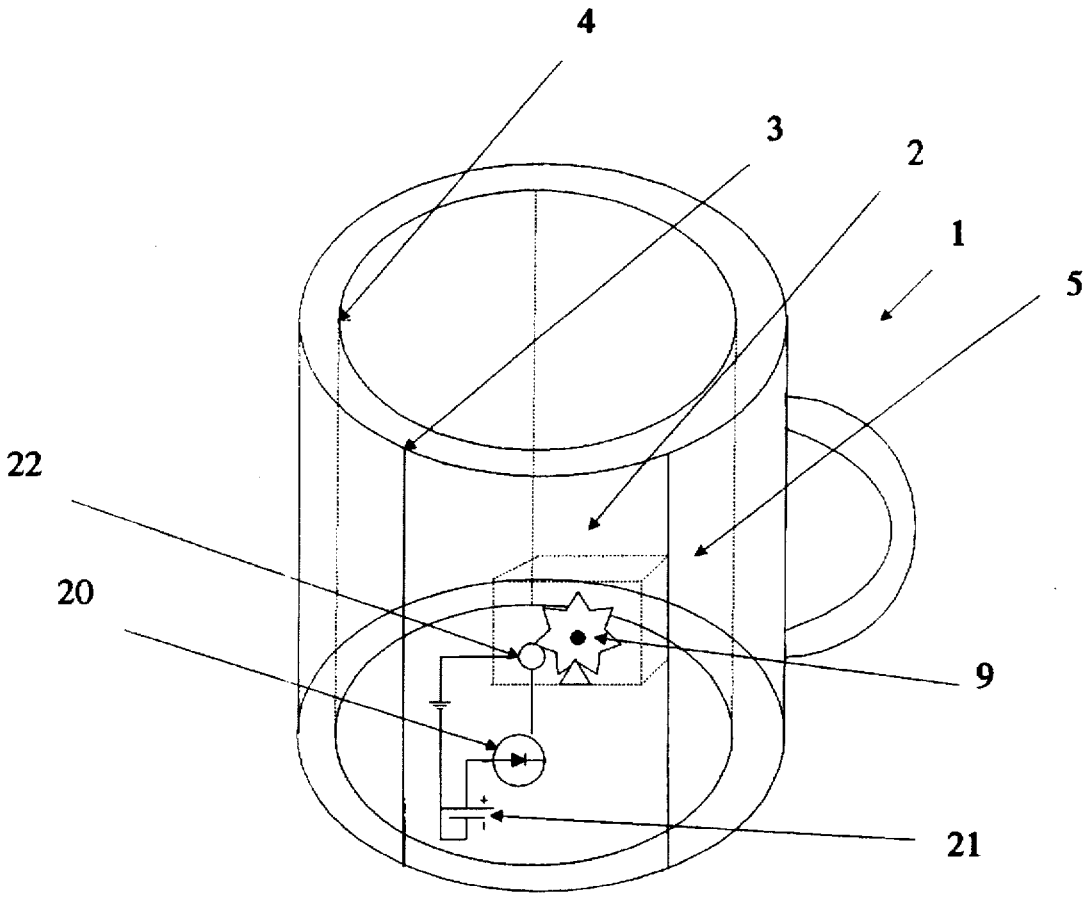
FIG. 5 is a cross-sectional view of a cup with a heat-activated electronic dynamic display disposed therein.

Referring now to FIG. 5, a heat-activated electronic motion display disposed within a vessel comprising outer vessel shell 3 and inner vessel shell 4, with display shell 5 interposed. A heat sensitive detector 20 is placed near the surface of inner vessel shell 4. Such heat sensitive detector 20 is electronically connected to energy source 22 and to electronic motion apparatus 22, shown in the figure as a motor connected to a fly wheel. At a certain pre-set temperature heat sensitive detector 20 is activated such that it sends a signal to electronic motion apparatus 22 which activates electronic motion apparatus 22 to provide for motion, in this case the turning of a fly wheel.

While this application has been described in connection with certain specific embodiments thereof, it should be understood that these are by way of example rather than by way of limitation, and it is not intended that the invention be restricted thereby.

What is claimed is:

1. A vessel for receiving and dispensing fluids comprising:

an outer vessel shell for grasping said vessel;

an inner vessel shell;

and means connecting the outer vessel shell to the inner vessel shell, such that the outer vessel shell and the inner vessel shell together define an open container, said open container defining an open space, said open space being open to ambient air;

said outer vessel shell and said inner vessel shell forming a cavity between them, said cavity containing:

a display shell for displaying motion to a person viewing said vessel;

a motion device disposed within said display shell;

and a means for moving said motion device coupled with said motion device, said means capable of activating said motion device to motion in response to the addition of fluids into said open space.

2. The vessel of claim 1 wherein said vessel has a handle.

3. The vessel of claim 1 wherein said outer shell and said display shell are constructed with transparent material.

4. A vessel for receiving and dispensing first fluids comprising:

an outer vessel shell for grasping said vessel;

an inner vessel shell;

and means connecting the outer vessel shell to the inner vessel shell, such that the outer vessel shell and the inner vessel shell together define an open container, said open container defining an open space, said open space being open to ambient air;

said outer vessel shell and said inner vessel shell forming a cavity between them, said cavity containing:

a display shell for displaying motion to a person viewing said vessel;

a fluid-containing cell, containing second fluid, disposed within said display shell;

a motion device cell disposed within said display shell;

a connecting means for connecting said fluid-containing cell to said motion device cell;

and a motion device disposed within said motion device cell, said motion device capable of being activated to motion by said second fluid upon the addition of said first fluid into said open space.

5. The vessel of claim 4 wherein said vessel has a handle.

6. The vessel of claim 4 wherein said outer shell and said display shell are constructed with transparent material.

7. A fluid-filled vessel comprising:

an outer vessel shell for grasping said vessel;

an inner vessel shell;

and means connecting the outer vessel shell to the inner vessel shell, such that the outer vessel shell and the inner vessel shell together define an open container, said open container defining an open space, said open space being open to ambient air, said open space containing fluid;

said outer vessel shell and said inner vessel shell forming a cavity between them, said cavity containing:

a display shell for displaying motion to a person viewing said vessel;

a motion device disposed within said display shell;

and a means for moving said motion device coupled with said motion device, said means capable of activating said motion device to motion in response to the presence of said fluid in said open space.

* * * * *